United States Patent [19]

Tanaka et al.

[11] 3,939,034

[45] Feb. 17, 1976

[54] TAB TAPE SPLICING APPARATUS

[75] Inventors: Iwao Tanaka, Tokyo; Yukio Shiratori, Higashikurume; Hidetaro Iijima, Urawa, all of Japan

[73] Assignee: Nichiban Co., Ltd., Tokyo, Japan

[22] Filed: June 7, 1974

[21] Appl. No.: 477,272

[30] Foreign Application Priority Data

Feb. 20, 1974 Japan ..... 49-19421

[52] U.S. Cl. ..... 156/522; 156/361; 156/367; 156/523; 156/580; 242/58.5

[51] Int. Cl.[2] ..... B32B 31/04

[58] Field of Search ..... 156/522, 523, 361, 580, 156/367; 242/58.5

[56] References Cited

UNITED STATES PATENTS 2,818,908 1/1958 Byrnes et al. ..... 156/522

3,066,723 12/1962 Remington et al. ..... 156/522

*Primary Examiner*—Edward G. Whitby

*Attorney, Agent, or Firm*—Haseltine, Lake & Waters

[57] ABSTRACT

There is provided a tab tape splicing apparatus for automatically fastening a tab tape on the adhesive surface of a rolled pressure-sensitive adhesive sheet at the end of the roll to provide a rolled pressure-sensitive adhesive tape with a tab at the leading end thereof. The apparatus comprises a rail fixedly mounted between a pair of upright frame members on both sides of a base to extend in the breadthwise direction of a pressure-sensitive adhesive sheet, a movable frame movable from side to side along the rail, a splicing roll attached to the movable frame for fastening a tab tape, a tape holder for holding a roll of tab tape, cutting means for cutting the tab tape, and means for moving the movable frame from side to side.

10 Claims, 12 Drawing Figures

TAB TAPE SPLICING APPARATUS

BACKGROUND OF THE INVENTION

The present invention relates to an apparatus whereby a tab tape for providing a tab at the leading end of a pressure-sensitive adhesive tape is automatically fastened to the adhesive surface at the end of a pressure-sensitive adhesive tape to be rolled up.

It has been the practice in the art to fasten a tab tape cut to a predetermined length to the adhesive surface at the end of each pressure-sensitive adhesive tape to produce a finished product so that at time of use the leading end of the rolled pressure-sensitive adhesive tape may be readily nipped off by the user. A disadvantage of this conventional practice is that the tab tape fastening operation must be effected manually on each individual rolled tape thus giving rise to a problem in working property and lack of uniformity in the position and posture of fastened tab tapes, and moreover a considerable skill is required to ensure a uniform result from the fastening operation.

On the other hand, it has been considered that this tab tape splicing operation could be performed with a greatly improved efficiency if an apparatus is to be developed in which pressure-sensitive adhesive tapes which have not been cut into individual tapes of a predetermined width as yet, is rolled up as a wide pressure-sensitive adhesive sheet and a tab tape is continuously and linearly spliced to the adhesive tapes in the sheet form at a predetermined position at the end thereof.

SUMMARY OF THE INVENTION

It is a principal object of the present invention to provide an automatic apparatus for linearly splicing a tab tape to a pressure-sensitive adhesive sheet in the breadthwise direction thereof.

It is another object of the present invention to provide an automatic tab tape splicing apparatus in which every splicing cycle including the steps of starting the operation, completing the fastening of a tab tape, cutting the fastened tab tape and restoring the apparatus to the original conditions can be effected in response to a single instruction of the operator and the apparatus can readily be restored into condition for repeated operations.

It is still another object of the present invention to provide an automatic tab tape splicing apparatus which is highly durable to withstand frequent repeated operations as well as the operation at high speeds.

In accordance with the present invention, there is thus provided an automatic tab tape splicing apparatus for automatically fastening a tab tape to the adhesive surface of a rolled pressure-sensitive adhesive sheet at the end thereof, the apparatus comprising a rail fixedly mounted between a pair of upright frame members on both sides of a base to extend in the breadthwise direction of a pressure-sensitive adhesive sheet, a movable frame movable from side to side along the rail, the movable frame having a splicing roll for fastening a length of tab tape to the adhesive surface of the pressure-sensitive adhesive sheet and a tape holder for carrying a roll of tab tape, cutting means for cutting the tab tape when the length of tab tape is fastened to the adhesive sheet, and means for moving the movable frame from side to side.

DESCRIPTION OF THE PREFERRED EMBODIMENTS

Figure 1:
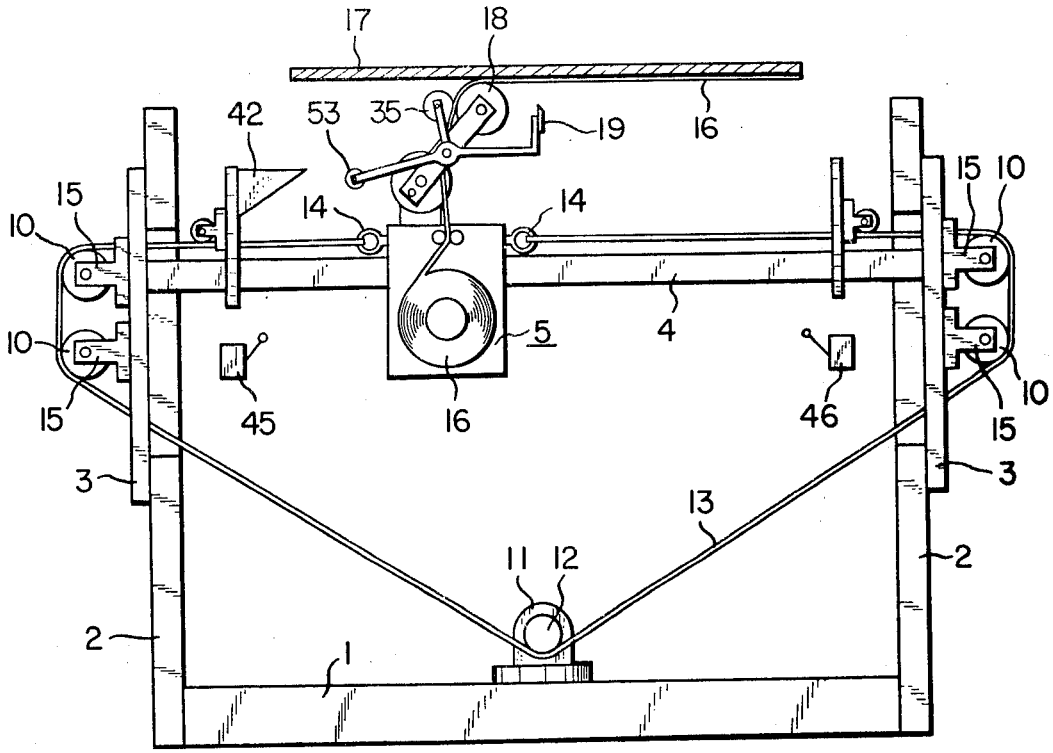
FIG. 1 is a front view showing an embodiment of an automatic tab tape splicing apparatus according to the present invention.

Referring first to FIGS. 1 to 4 showing an embodiment of the invention, a mounting plate 3 is attached to a frame 2 vertically provided at each side of a base 1, and fixedly mounted between the mounting plates 3 is a rail 4 on which is carried a movable frame 5. The movable frame 5 comprises an upper frame member 6 which slides along the upper surface of the rail 4, a rear frame member 7 secured to the back of the upper frame member 6 and movable in sliding contact with the back and bottom surfaces of the rail 4, a front frame member 8 secured to the front side of the upper frame member 6 to slide along the front side of the rail 4, and an upwardly extended frame member 9 secured to the upper faces of the front frame member 8 and the upper frame member 6.

The movable frame 5 is alternately pulled in both directions to reciprocate along the rail 4 by a wire rope 13 tightly stretched over fixed pulleys 10 and a pulley 12 of a motor 11. Numeral 14 designates fastening members which fasten the ends of the wire rope 13 to the sides of the movable frame 5 and the fastening members 14 are secured to the frame member 6 of the movable frame 5. Numeral 15 designate bearings for the fixed pulleys 10, which are attached to the mounting plates 3.

The movable frame 5 is further provided with a roll of tab tape 16, a splicing roll 18 for fastening a length of the tab tape 16 to the adhesive surface of a pressure-sensitive adhesive sheet 17, and a cutting blade 19 for cutting the fastened tab tape 16.

A core holder 20 carries a press-fit roll of the tab tape 16 and is rotatably mounted on a shaft 22 which is secured by a nut 21 to the front frame member 8 of the movable frame 5. The shaft 22 is provided at the central portion thereof with a tapped hole 23 which extends in the longitudinal direction, and a bolt 24 is fit in the tapped hole 23. Fitted on the bolt 24 is a washer 25 placed in contact with the end face of the core holder 20 and a spring 26 for pressing the washer 25 against the core holder 20, and a nut 27 for restraining the spring 26 is threadedly mounted on the bolt 24 and the nut 27 is secured to the bolt 24 by a set screw 28. By pressing the washer 25 against the end face of the core holder 20, any excessive rotation of the core holder 20 is controlled, and the force of the spring 26 is regulated by turning the nut 27. Numeral 29 designates a case for the tab tape 16 which is secured to the front frame member 8 of the movable frame 5 and whose opening is closed by a cover 30. Numeral 52 designates a peep hole formed in the cover 30 and the presence of the tab tape 16 may be confirmed through the peep hole 52.

The splicing roll 18 is attached to an arm 31 by a shaft 37 and the arm 31 is secured to a pivot shaft 34 of a rotary solenoid 33 which is attached to the extension frame member 9 of the movable frame 5.

Numeral 35 designates a pressure roll for pressing the tab tape 16 against the splicing roll 18 and it is pivotably secured to an arm 36 which is secured to the arm 31 by the shaft 37. A spring 38 is tightly stretched between the arms 31 and 36 to press the pressure roll 35 against the splicing roll 18.

The cutting blade 19 for cutting the tab tape 16 is secured to the end of an arm 39 which is integral with an arm 40 for rocking the arm 39, and a boss 41 of the arm 40 is pivotably mounted on the shaft 37. A roll 53 is pivotably secured to the arm 40 so that the cutting blade 19 is moved vertically in accordance with the movement of the roll 53 along the inclined surface of an inclined plate 42 provided at the left end of the rail 4.

The tab tape 16 is pulled out to the upward of the case 29 between guide pins 43 attached to the case 29 and through a case window 44 and it is then led past the shaft 37 and between the pressure roll 35 and the splicing roll 18 to be placed on the splicing roll 18. When the movable frame 5 is ready in its starting position at the right end of the rail 4, the rotary solenoid 33 is not energized and the splicing roll 18 is not in contact with the pressure-sensitive adhesive sheet 17. When a predetermined length of the adhesive sheet 17 is delivered in a direction crossing the rail 4 at right angles, a counter meter which is not shown comes into operation and stops the movement of the adhesive sheet 17. When the supply of the adhesive sheet 17 stops, the rotary solenoid 33 is energized so that the splicing roll 18 presses the tab tape 16 against the adhesive sheet 17 and at the same time the motor 11 is energized to cause the movable frame 5 to start moving to the left. In response to the movement of the movable frame 5, the tab tape 16 is fastened to the adhesive surface of the adhesive sheet 17 as it is successively pulled out.

When a predetermined length of the tab tape 16 is thus fastened to the adhesive sheet 17, the roll 53 on the arm 40 is moved along the inclined surface of the inclined plate 42 and thus the cutting blade 19 is raised to cut the tab tape 16. Upon completion of the cutting operation, a switch 45 is depressed by the movable frame 5 so that the rotary solenoid 33 is deenergized and the splicing roll 18 is lowered to separate from the adhesive sheet 17, and at the same time the motor 11 is rotated in the reverse direction to move the movable frame 5 to the right. When the roll 53 comes out of engagement with the inclined surface of the inclined plate 42, the cutting blade 19 is lowered. When the movable frame 5 returns to the initial position, a switch 46 is depressed by the movable frame 5 and the motor 11 stops operating. Repetitions of the above-described process accomplish automatic splicing of the predetermined length of the tab tape 16 to the succeeding lengths of the pressure-sensitive adhesive sheet.

Figure 4:
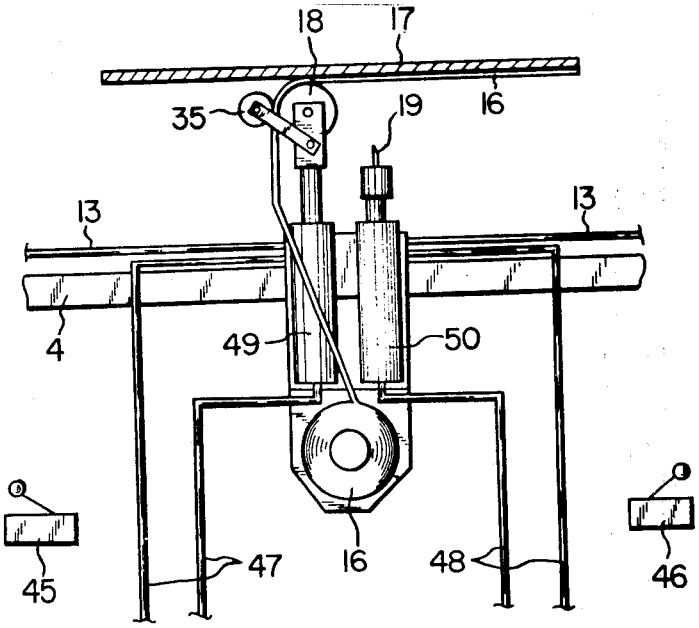
FIG. 4 is a front view showing a modified form of the apparatus shown in FIG. 1.
Figure 2:
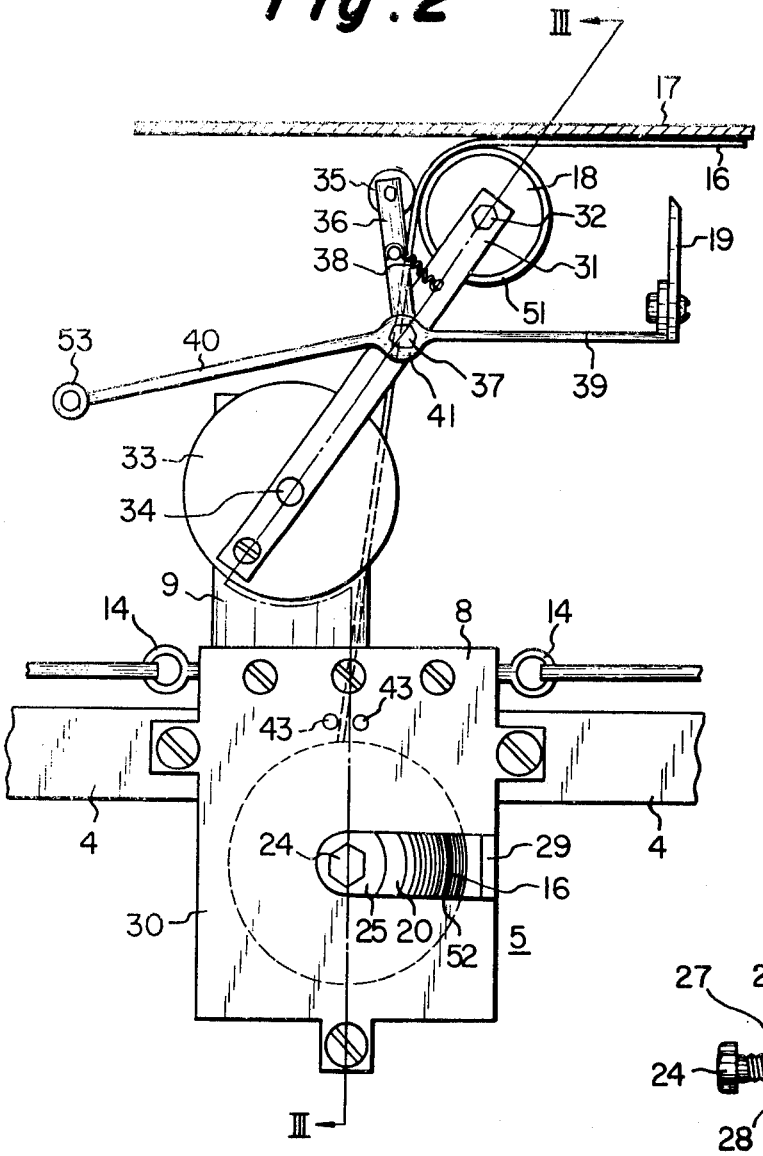
FIG. 2 is an enlarged from view showing a portion of the apparatus of FIG. 1.
Figure 3:
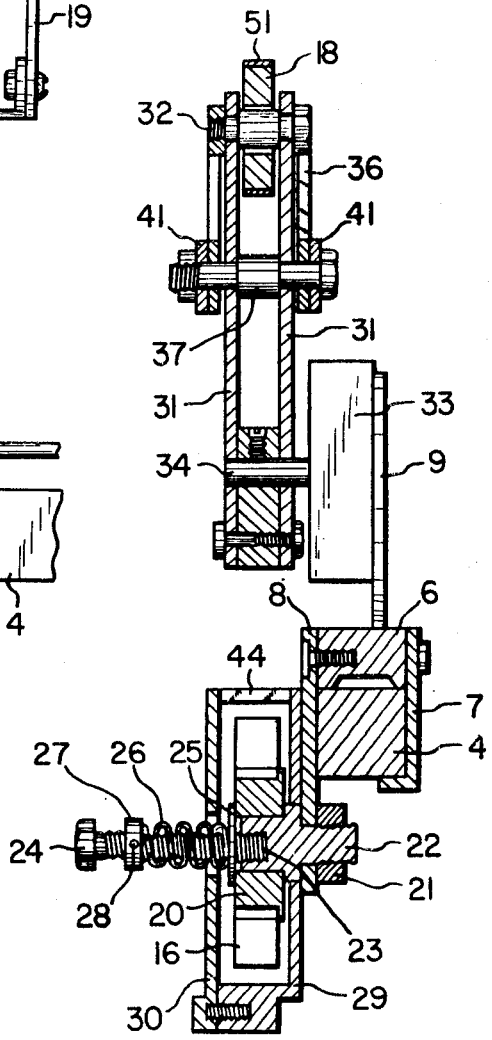
FIG. 3 is a sectional view taken along the line III—III of FIG. 2.

The cutting blade 19 and the splicing roll 18 may be respectively moved vertically by hydraulic piston cylinder units 49 and 50 through hydraulic circuits 47 and 48 as shown in FIG. 4, or alternately the cutting blade 19 may be provided separately with the movable frame 5 and fixedly mounted at the left side thereof. Further, the movable frame 5 may be provided with a braking system, while either one or both of the splicing roll 18 and the pressure roll 35 may be made from an elastic material 51 such as rubber or foamed plastic material so that the tab tape 16 may be more effectively pressed. Furthermore, the means for moving the movable frame 5 is not limited to the rope and it may be comprised of a flat belt, a pinion and rack, hydraulic mechanism or the like.

Referring now to FIGS. 5 through 12, another embodiment of the invention will be described in detail.

Figure 5:
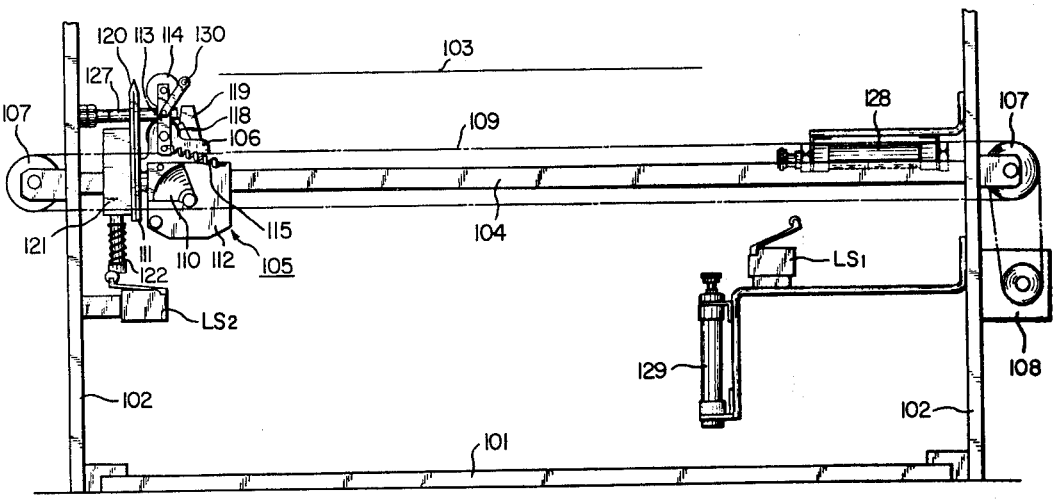
FIG. 5 is a front view showing another embodiment of the present invention.

In FIG. 5, fixedly mounted between a pair of frames 102 vertically arranged on the both sides of a base 101 is a guide rail 104 which is extended in the breadthwise direction of the adhesive surface of a pressure-sensitive adhesive sheet 103, and a movable frame 106 having a tab tape holder 105 is slidably carried on the guide rail 104. The movable frame 106 may for example be fitted on the rail 104 so that the movable frame 106 may smoothly slide along the rail 104 without any chattering, and it is connected to a chain or wire rope 109 tightly stretched between guide pulleys 107 attached to the frames 102 and driven by a motor 108 and thus the movable frame 106 is movable in both directions along the rail 104 in accordance with the rotation of the motor 108. The tab tape holder 105 which is attached to the movable frame 106 forms a casing along with a cover 112 having an opening 111 so that the presence of a roll of tab tape 110 contained therein may be confirmed through the opening 111. As shown in FIG. 5 and FIGS. 6 through 9 which illustrate in detail the movable frame 106 and its associated members, an arm 113 which is rotatably attached to the movable frame 106 has a splicing roll 114 rotatably pivoted at the upper end thereof so that the tab tape 110 brought out from the tape holder 105 and guided along the adhesive surface of the pressure-sensitive adhesive sheet 103 is pressed and fastened thereto. The arm 113 is normally biased into a upright position by a spring 115 extended between the arm 113 and the movable frame 106 and the arm 113 also is engaged with a stopper 116 provided on the movable frame 106 to prevent any further movement of the arm 113 from its upright position. A ratchet wheel 118 is secured to a pivot shaft 117 of the arm 113 to rotate along with it, and the ratchet wheel 118 forms, along with a pawl 119 attached to the movable frame 106, a ratchet mechanism which allows the arm 113 to rotate only in a direction in which it is tiltable.

Figure 10:
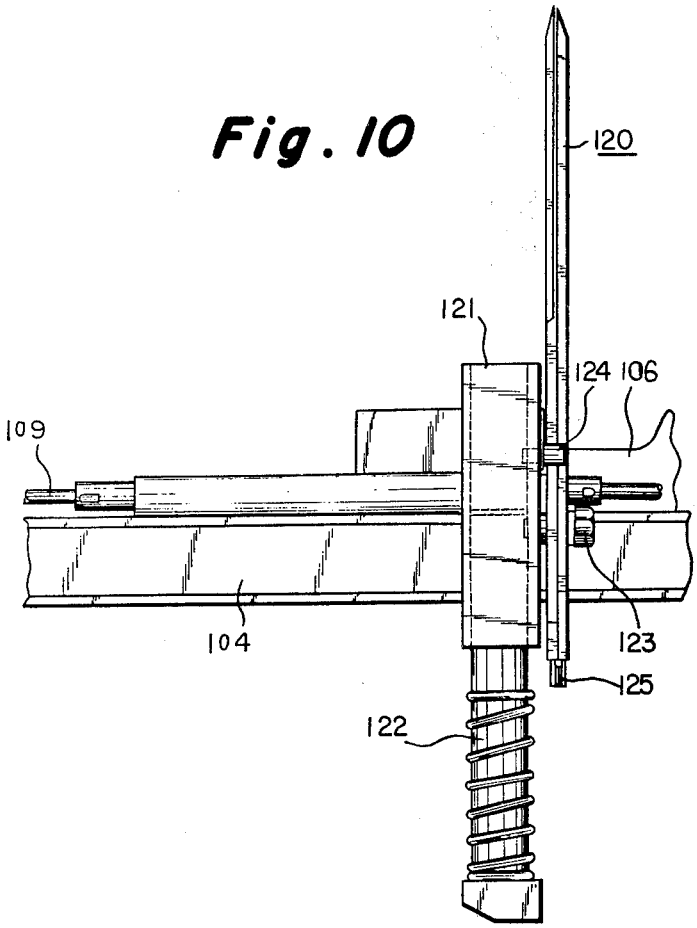
FIG. 10 is an enlarged front view showing the cutting scissors and its associated members of the apparatus shown in FIG. 5.
Figure 11:
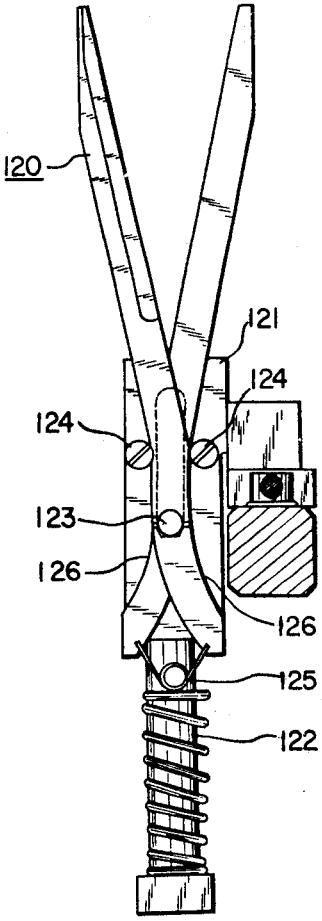
FIG. 11 is an enlarged left side view of FIG. 10.

In the illustrated embodiment, the movable frame 106 is provided with cutting scissors 120 for cutting the tab tape 110 after it has been fastened and it is pivotted, as shown in FIGS. 10 and 11, at 123 to a sliding bar 122 slidably fitted in a slide block 121 which is fixedly mounted on the movable frame 106. Consequently, the cutting scissors 120 are slidable over the slide block 121 between a pair of guide rolls 124 mounted on the slide block 121 to project therefrom, and in this way the blades of the cutting scissors 120 which are normally opened by the action of an expanding spring 125 attached to the tail ends of the scissors 120, are closed as arcuated portions 126 at the scissor tail ends proceed between the guide rolls 124 in accordance with the sliding movement of the sliding bar 122. In other words, the scissors 120 are opened and closed in accordance with the vertical movement of the scissors 120 within a predetermined distance.

While, in this embodiment, the cutting scissors 120 are attached to the movable frame 106 so that it is movable along with the splicing roll 114 at the rear thereof, they may be fixedly mounted for example on the frame 102 provided that the movable frame 106 is permitted to pass the scissors 120 at its terminal position, i.e., the fastening ending position, and thus the position of the scissors 120 can be selected as desired in accordance with the operating requirements.

In the embodiment of FIG. 5, the movable frame 106 starts moving at the left end of the rail 104 and stops its movement at the right end thereof, and a projecting rod 127 is attached to the frame 102 at the movable frame starting position on the guide rail 104 so that the pawl 119 of the ratchet mechanism is rotated to release the control on the rotation, and this releasing is effected by a change in the position due to the movement of the movable frame 106.

Further, a hydraulic piston cylinder unit 128 which is secured to the pivot shaft 117 of the arm 113, is provided at the movable frame terminal position on the rail 104 so that a projecting bar 131 secured to the pivot shaft 117 of the arm 113 strikes into the hydraulic piston cylinder unit 128 to rotate and tilt the arm 113, and another hydraulic piston cylinder unit 129 is also provided which forces upward the sliding bar 122 for opening and closing the blades of the scissors 120.

In FIGS. 5 through 11, numeral 130 designates a pressure roll for holding the tab tape 110 between it and the splicing roll 114, and particularly the pressure roll 130 serves to carry the tab tape 110 thereon when a predetermined length of the tab tape 110 is spliced and the movable frame 106 returns to its starting position.

To control the above-described starting and stopping of the movable frame 106 and the operation of the cutting scissors 120, two limit switches $LS_1$ and $LS_2$ are respectively mounted on the frames 102 at the positions corresponding to the starting and terminal positions of the movable frame 106, and the associated relays, timers and electromagnetic valves for controlling the hydraulic piston cylinder units are controlled in accordance with the operation of the limit switches $LS_1$ and $LS_2$ whereby to control the entire operation of the apparatus. An exemplary form of the electric circuitry including this control system is shown in FIG. 12, and the operation of the above-described second embodiment will now be described with reference to FIG. 12.

Figure 12:
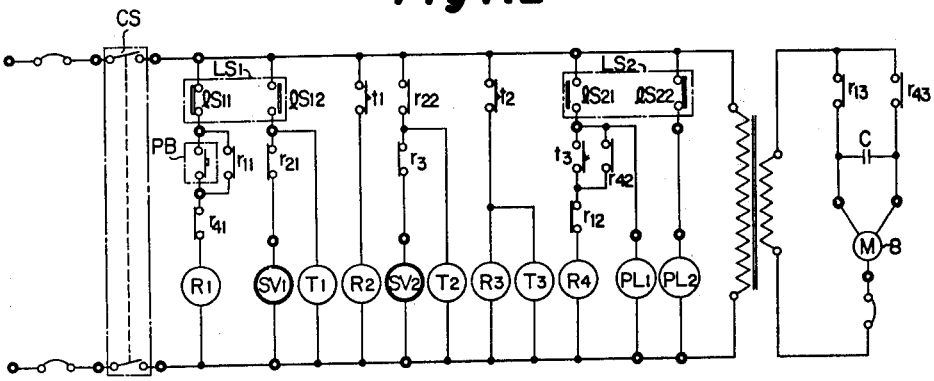
FIG. 12 is a circuit diagram of the control system for the apparatus of the invention.
Figure 6:
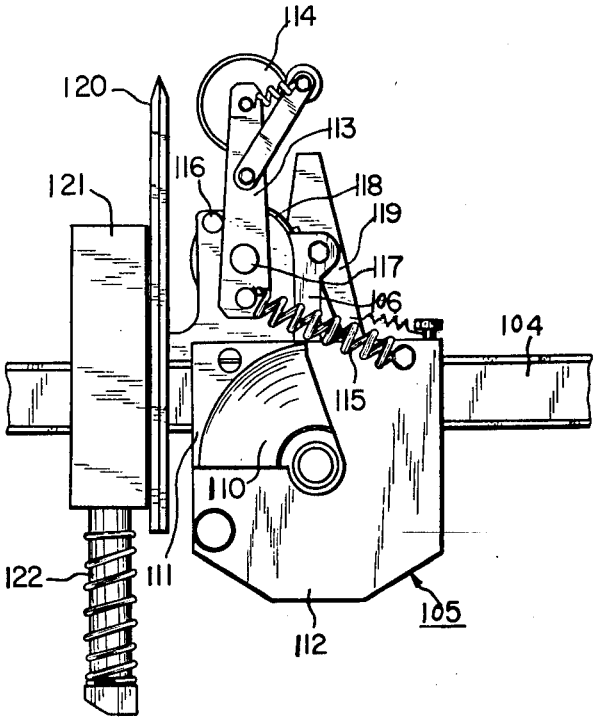
FIG. 6 is an enlarged front view showing the movable frame and its associated members of the apparatus shown in FIG. 5.
Figure 7:
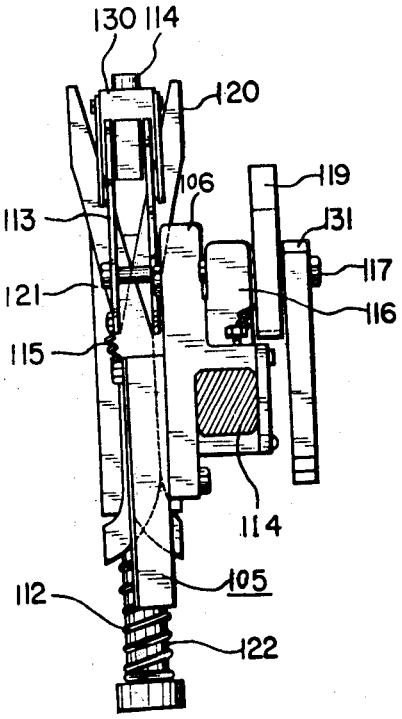
FIG. 7 is an enlarged right side view of FIG. 6.
Figure 8:
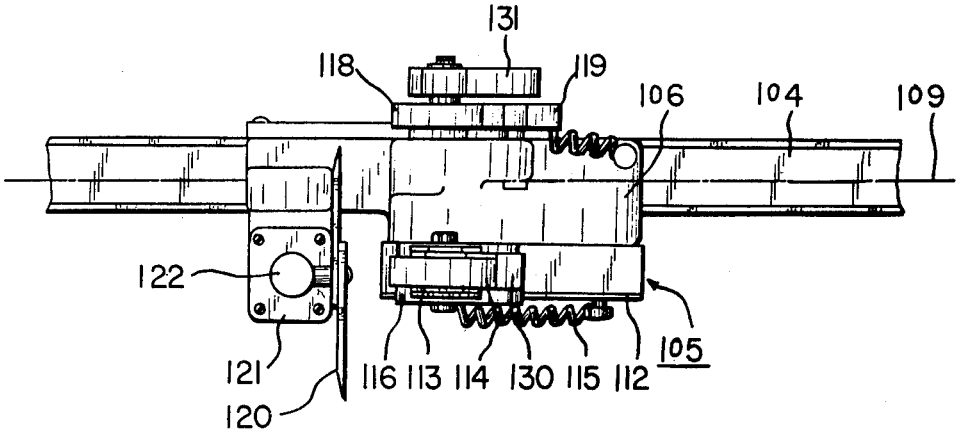
FIG. 8 is an enlarged plan view of FIG. 6.
Figure 9:
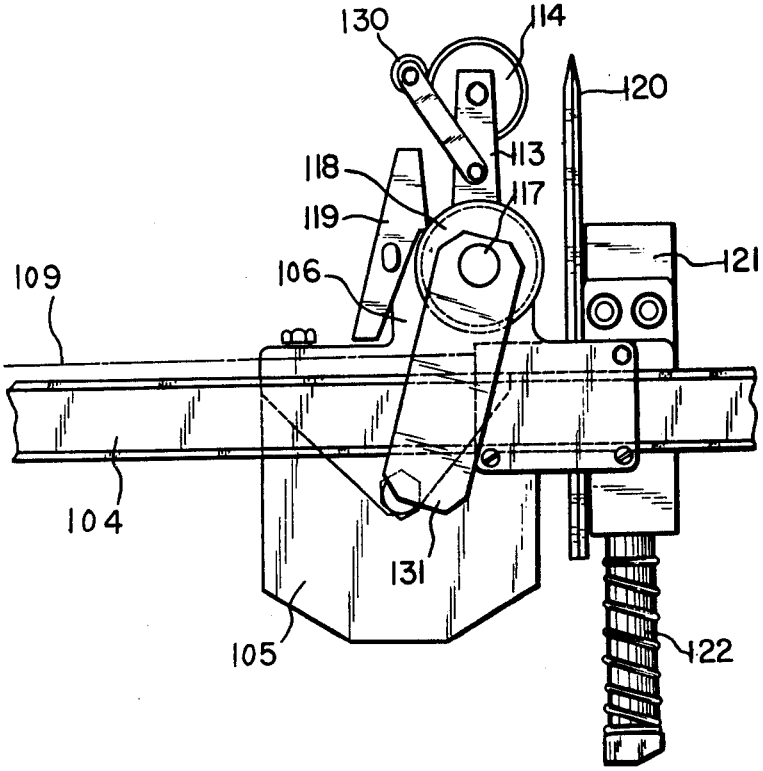
FIG. 9 is an enlarged back view of FIG. 6.

FIG. 12 shows the conditions in the electric circuitry which correspond to the conditions in the apparatus shown in FIG. 5, i.e., the movable frame 106 is stationary at its starting position and the limit switch $LS_2$ is switched on to turn a pilot lamp $PL_2$ on through its contact $lS_{22}$. In FIGS. 5 and 12, with a power switch CS closed, when the tab tape splicing position of the pressure-sensitive adhesive sheet 103 comes to a rest above the rail 104, that is, when a predetermined amount of the adhesive sheet 103 is rolled up, an actuating switch PB is closed for a predetermined period of time by the output of a counter or the like which counts the amount of the rolled adhesive sheet 103. When this occurs, a B contact $lS_{11}$ of the limit switch $LS_1$ and a B contact $r_{41}$ of a relay $R_1$ remain closed so that the relay $R_1$ is energized and self-holds its energized state by its A contact $r_{11}$ and at the same time a motor 108 is rotated in the forward direction through a relay A contact $r_{13}$ to move the movable frame 106 to the right in FIG. 5. This movement of the movable frame 106 resets the limit switch $LS_2$ so that its A contact $lS_{22}$ is opened and its B contact $lS_{21}$ is closed to turn the pilot lamp $PL_2$ off and a pilot lamp $PL_1$ on, thus indicating that the splicing operation is taking place. When the movable frame 106 is in motion, the splicing roll 114 fastens the tab tape 110 to the adhesive surface of the pressure-sensitive adhesive sheet 103 and the arm 113 is moved while it is held in the upright position by the action of the stopper 116. When the tab tape 110 is fastened to the adhesive sheet 103 over the entire breadth thereof and the movable frame 106 comes to the terminal position, the limit switch $LS_1$ is actuated. With the limit switch $LS_1$ actuated, its B contact $lS_{11}$ is opened to deenergizee the relay $R_1$ and its A contact $lS_{12}$ is closed to actuate an electromagnetic valve $SV_1$ and a timer $T_1$. This actuation of the electromagnetic valve $SV_1$ brings the hydraulic piston cylinder unit 129 into operation through a hydraulic control system which is not shown and causes the cutting scissors 120 to cut the tab tape 110. On the other hand, at the expiration of a predetermined time after the actuation of the timer $T_1$, a relay $R_2$ is energized by the closing of its A contact $t_1$ and the electromagnetic valve $SV_1$ is deenergized by the opening of its B contact $r_{21}$, whereby the cutting scissors 120 are returned to their original position and an electromagnetic valve $SV_2$ and a timer $T_2$ are actuated by the closing of A contact $r_{22}$. In response to the actuation of the electromagnetic valve $SV_2$, the hydraulic piston cylinder unit 128 comes into operation through a hydraulic control system which is not shown so that the lower end of the arm 113 is pressed by the piston rod of the cylinder unit 128 and thus the arm 113 is tilted to lower the position of the splicing roll 114 below the lower surface of the adhesive sheet 103. On the other hand, the actuation of the timer $T_2$ causes its A contact $t_2$ to close at the expiration of a predetermined time and consequently a relay $R_3$ is energized to open its B contact $r_3$ to deenergize the electromagnetic valve $SV_2$ and deactivate the hydraulic cylinder unit 128. At the same time, a timer $T_3$ starts operating and closes its A contact $t_3$ after the expiration of a predetermined time. When the A contact $t_3$ is closed so that a relay $R_4$ is energized, its self-holding action is maintained by its A contact $r_{42}$ and at the same time a A contact $r_{43}$ is closed to rotate the motor 108 in the reverse direction and thereby to move the movable frame 106 to the left in FIG. 5. In this case, the arm 113 is held in its tilted position by the ratchet mechanism and therefore the splicing roll 114 on the movable frame 106 does not come into contact with the adhesive sheet 103 thus permitting the movable frame 106 to move smoothly. With the movable frame 106 returned to the starting position, the limit switch $LS_2$ is again actuated and at the same time the end of the projecting rod 127 strikes against the pawl 119 to release the ratchet mechanism and bring the arm 113 back into the initial upright position. The actuation of the limit switch $LS_2$ also turns the pilot lamp $PL_1$ off and the pilot lamp $PL_2$ on to indicate that the apparatus is ready for the next splicing operation. At the same time, the B contact $lS_{21}$ is opened so that the relay $R_4$ is deenergized and the A contact $r_{43}$ is opened to bring the motor 108 to a stop.

While the entire process of a single splicing cycle has been described so far, it is needless to say that the similar process can be repeated by reclosing the actuating switch PB in the above condition.

It will thus be seen from the foregoing description that the present invention provides an operation in which a series of steps including fastening and cutting tab tape are effected automatically. Particularly, by virtue of the fact that in the second embodiment the rotation of a splicing roll supporting arm is effected by means of a spring and a ratchet mechanism, not only the repeated operation of the apparatus at frequent intervals does not cause it to become faulty due to the generation of heat or the like, but also it does not give rise to any operating difficulties. Further, even if the splicing operation is effected at a high speed under heavy pressure, the high strength of the apparatus enables it to operate with a high degree of durability. Still further, the use of cutting scissors ensures a positive cutting operation and adjustment of the cut area. Thus, it is evident that the present invention has a number of advantages and therefore it is highly useful from the industrial point of view.

What is claimed is:

1. An apparatus for splicing a tab tape to a pressure-sensitive adhesive sheet comprising: a guide rail arranged opposite to an adhesive surface of a pressure-sensitive adhesive sheet and extending in the breadthwise direction of said sheet; a movable frame slidably carried on said guide rail and having a tab tape holder; an arm pivotably attached to said movable frame and normally biased into an upright position by a spring to guide, press and fasten a tab tape to said adhesive surface of said pressure-sensitive adhesive sheet; a splicing roll rotatably attached to one end of said arm; a stopper attached to said movable frame to restrain the movement of said arm in said upright position; a ratchet mechanism mounted on said movable frame whereby said arm is allowed to rotate in a direction in which said arm is tiltable; a projecting rod provided at a starting position of said movable frame on said guide rail to release said ratchet mechanism; a hydraulic piston cylinder unit provided at a terminal position of said movable frame on said guide rail to rotate said arm in said tiltable direction; cutting means for cutting said tab tape between said splicing roll and an end edge of said pressure-sensitive adhesive sheet; and drive controlling means for reciprocating said movable frame between said starting position and said terminal position.

2. An apparatus according to claim 1, wherein said movable frame is slidably mounted on said guide rail and connected to a chain or wire stretched over a plurality of guide pulleys arranged between a pair of frame members and driven by a motor, whereby said movable frame is moved from side to side along said guide rail in accordance with the rotation of said motor.

3. An apparatus according to claim 1, wherein said ratchet mechanism comprises a ratchet wheel attached to a pivot shaft of said arm pivotably attached to said movable frame and rotatable along with said arm, and a pawl attached to said movable frame, whereby said arm is permitted to rotate only in said tiltable direction.

4. An apparatus according to claim 1, wherein a projecting rod is attached to one of said frame members at said movable frame starting position on said guide rail whereby to rotate said pawl of said ratchet mechanism to release the restraint on the rotation of said arm.

5. An apparatus according to claim 1, wherein hydraulic piston cylinder means is provided at said terminal position of said movable frame on said guide rail to come into engagement with a projecting bar attached to said pivot shaft of said arm and rotate and tilt said arm.

6. An apparatus according to claim 1, wherein said cutting means comprises a scissors for cutting the tab tape when a length of said tab tape has been fastened to an end of the pressure-sensitive adhesive sheet are mounted on said movable frame, said cutting scissors are pivotably secured to a sliding rod slidably fitted in a slide block attached to said movable frame and are mounted to be slidable on said slide block between a pair of projecting rolls mounted on said slide block, and the blades of said cutting scissors are normally held open by the action of an expanding spring attached to the tail ends of said cutting scissors, whereby said blades are closed when arcuated portions of said scissors tail ends are advanced between said projecting rolls by the sliding motion of said sliding rod.

7. An apparatus according to claim 1 further comprising drive controlling means whereby said movable frame is automatically reciprocated on said guide rail between said starting position and said terminal position in response to closing for a predetermined time of an actuating switch adapted to indicate that a predetermined amount of said pressure-sensitive adhesive sheet has been rolled up.

8. An apparatus according to claim 6, wherein said cutting scissors is provided with lifting operating means for raising said cutting scissors to the position of said tab tape.

9. An apparatus according to claim 1, wherein said cutting means comprises a cutting blade attached to one end of an arm, said arm having a roll pivoted at the other end thereof, said arm is pivotally secured to said movable frame, whereby said cutting blade is moved vertically to cut said tab tape in accordance with the movement of said pivoted roll over an inclined plate provided at one end of said guide rail.

10. An apparatus according to claim 9, wherein said cutting means is moved vertically by a hydraulic piston cylinder unit actuated by a hydraulic circuit.

* * * * *